US006164378A

United States Patent [19]

Coronado

[11] Patent Number: 6,164,378

[45] Date of Patent: Dec. 26, 2000

[54] PRESSURE-COMPENSATION SYSTEM

[75] Inventor: Martin P. Coronado, Cypress, Tex.

[73] Assignee: Baker Hughes Incorporated, Houston, Tex.

[21] Appl. No.: 09/008,883

[22] Filed: Jan. 20, 1998

[51] Int. Cl.[7] ..... E21B 33/127

[52] U.S. Cl. ..... 166/187; 166/387

[58] Field of Search ..... 166/187, 53, 26.03, 166/387, 386, 120

[56] References Cited

U.S. PATENT DOCUMENTS

| | | | |
|---|---|---|---|
| 4,260,164 | 4/1981 | Baker et al. | 166/187 |
| 4,589,484 | 5/1986 | Doherty et al. | 166/187 |
| 4,655,292 | 4/1987 | Halbardier | 166/387 |
| 4,840,231 | 6/1989 | Berzin et al. | 166/387 |
| 4,934,460 | 6/1990 | Coronado | 166/187 |
| 5,549,165 | 8/1996 | Brooks | 166/187 |

FOREIGN PATENT DOCUMENTS 2 297 822A 8/1996 United Kingdom .

OTHER PUBLICATIONS

Dreesen, et al., "Openhole Packer for High–Pressure Service in a 500° Percambrian Wellbore," IDAC/SPE 14745, Feb. 1986.

*Primary Examiner*—William Neuder

*Attorney, Agent, or Firm*—Duane, Morris & Heckscher LLP

[57] ABSTRACT

A downhole tool, such as a packer or bridge plug, employing an inflatable element, is disclosed. A pressure-compensation system is in fluid communication with the annular space between the body of the packer or plug and the inflatable element. The compensation system responds to thermally induced pressure load changes within the wellbore by allowing fluid to escape from beneath the inflated element when increases in fluid temperature in the wellbore increase the pressure under the element. The system additionally supplies fluid behind the element should the wellbore fluids decrease in temperature, thus lowering the pressure under the inflatable element. The compensation system counteracts what would otherwise be a tendency for a pressure increase, which could subject the inflatable element to failure from overpressure and, conversely, supplies fluid to under the inflated element so that it can prevent unwanted loss of sealing or anchoring integrity of the packer or plug due to what would have otherwise been a pressure decrease behind the inflatable element.

20 Claims, 1 Drawing Sheet

PRESSURE-COMPENSATION SYSTEM

FIELD OF THE INVENTION

The field of this invention relates to pressure-compensation systems, particularly those useful for inflatable elements of downhole packers for compensation to pressure changes induced by thermal effects.

BACKGROUND OF THE INVENTION

Inflatable packers of varying design have been in use downhole. When the downhole thermal conditions are fairly stable, there is a negligible effect on the inflated pressure of the elastic sealing element. If, however, after inflation, the surrounding temperature of the well fluids increases, the thermal loads applied to the fluid within the expanded element increase as the pressure rises in response to fluid expansion. While some tolerance can be built into the design, the temperature gradient can become sufficiently severe in an upward direction so as to cause sufficient incremental pressure in the inflated element to cause it to burst. In the other direction, where the temperature of the surrounding well fluids cycles downwardly, a resulting decrease in internal pressure is experienced within the inflated element and, depending on the circumstances and the severity, a loss of sealing and anchoring engagement of the packer or bridge plug with the casing wall can occur.

Prior designs have emphasized relief of excess pressure by allowing fluid from inside the element to escape into the well fluids upon a rise in internal pressure within the element beyond a predetermined level less than the failure pressure of the element.

Accordingly, one of the objects of the present invention is to provide a compensation system that responds to a rise or a fall or cycling involving rises and falls in temperature and compensates for the thermal effects by respectively allowing fluid to be removed from under the inflated element or adding fluid to the space under the element. Another object of the present invention is to provide a system that compensates for increases and decreases in thermally induced pressure loads, while at the same time isolating the compensation system from wellbore fluids.

SUMMARY OF THE INVENTION

A downhole tool, such as a packer or bridge plug, employing an inflatable element, is disclosed. A pressure-compensation system is in fluid communication with the annular space between the body of the packer or plug and the inflatable element. The compensation system responds to thermally induced pressure load changes within the wellbore by allowing fluid to escape from beneath the inflated element when increases in fluid temperature in the wellbore increase the pressure under the element. The system additionally supplies fluid behind the element should the wellbore fluids decrease in temperature, thus lowering the pressure under the inflatable element. The compensation system counteracts what would otherwise be a tendency for a pressure increase, which could subject the inflatable element to failure from overpressure and, conversely, supplies fluid to under the inflated element so that it can prevent unwanted loss of sealing or anchoring integrity of the packer or plug due to what would have otherwise been a pressure decrease behind the inflatable element.

DETAILED DESCRIPTION OF THE PREFERRED EMBODIMENT

Figure 1:
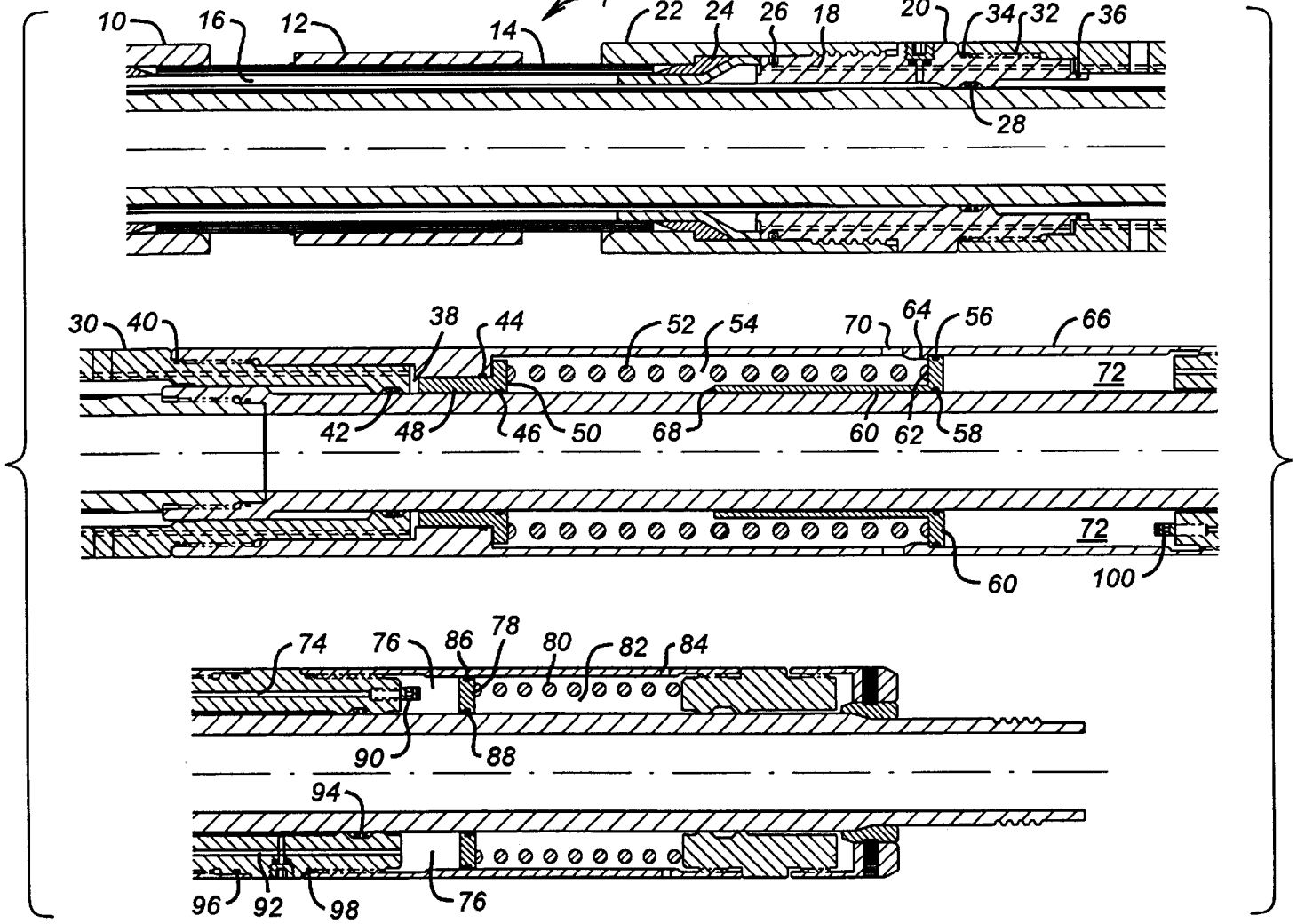
FIG. 1 illustrates a typical downhole packer in sectional elevational view, showing the compensation system of the present invention in fluid communication with the area under the packer, in a schematic manner which is not drawn to scale.

FIG. 1 shows, in a relaxed state, an inflatable packer P. The packer P has a top sub (not shown) on which is mounted sleeve 10, which is connected to tubing or other means to properly position it in the wellbore. The packer P has a sealing element 12 which expands into contact with the casing or wellbore for a seal. The packer as shown in the upper portion of FIG. 1 is of a known design, and the present invention relates to the pressure-compensation system. The sealing element 12 is mounted over overlapping ribs 14, which expand outwardly to push the sealing element 12 into contact with the casing or wellbore. An annular space 16 receives the inflation pressure in a manner well-known in the art. The annular space 16 is in fluid communication with passage 18, which extends through sleeve 20. An outer sleeve 22 retains ring 24 when the sealing element 12 is expanded. Ring 24 is welded to ribs 14 in a manner as described in U.S. Pat. No. 5,143,154.

Seals 26 and 28 prevent the escape of fluid and channel all flow through passage 18. As shown in FIG. 1, sleeve 20 can be made from several components, including lower component 30 attached at thread 32. Seals 34 and 36 seal off the joint to ensure the integrity of passage 18 down to chamber 38. Again, seals 40 and 42, along with seals 44 and 46, maintain the integrity of chamber 38. When the pressure is increased in annular space 16, that pressure is transmitted through passage 18 into chamber 38, which in turn displaces piston 48. Piston 48 (not drawn to scale) has a lower surface 50, against which abuts spring 52. Spring 52 is in cavity 54, which is in fluid communication with wellbore fluids through port 70 and sealed off by seals 44 and 46 on piston 48, as well as seals 56 and 58 on piston 60. Piston 60 has a surface 62 which engages travel stop 64 on sleeve 66. Piston 60 also has a top surface 68 which acts as a travel stop for piston 48 when contacted by bottom surface 50 of piston 48.

Cavity 54 is vented through port 70 to allow the spring 52 to compress and expand without creating fluid pressure on piston 60. It is only with piston 48 bottomed on piston 60 that piston 60 is urged to move downwardly, responsive to an increase in pressure in annular space 16. However, for normal setting of the packer P, the pressure developed is generally sufficient to compress spring 52 such that the piston 48 moves a distance until it contacts top surface 68 of piston 60. While piston 48 is moving, the pressure integrity of chamber 38 is maintained because of seals 44 and 46. That situation continues to apply even when piston 48 displaces piston 60, which results in a volume reduction of chamber 72. The displaced fluid from chamber 72 goes through passage 74 and into chamber 76. Chamber 76 is isolated from well fluids by piston 78, which is biased by a spring 80 residing in chamber 82. Chamber 82 is vented through port 84 and is, thus, exposed to well fluids. Chamber 76 is isolated from well fluids by seals 86 and 88 on piston 78. Relief valve 90 in passage 74 allows fluid to pass from chamber 72 to chamber 76, after a predetermined pressure in chamber 72 is reached, as piston 60 is pushed down by piston 48 in the event of a rise in wellbore fluid temperature, which increases the pressure in annular space 16. Relief valve 90 relieves at a pressure below the rupture limit of the packer P. Relief valve 90 delays the onset of compensation when piston 48 is already in contact with piston 60. The volume of chamber 72 represents the degree of available compensation for pressure increases in annular space 16.

Chamber 72 also communicates with chamber 76 through passage 92. Seals 94, 96, and 98 prevent bypassing around passage 92. A check valve 100 permits flow from chamber 76 into chamber 72 upon a predetermined differential pressure between chambers 76 and 72. Thus, if the wellbore temperature is reduced, decreasing the pressure in space 16, thus lowering the pressure in chamber 72 as piston 60 begins to advance, spring 80 biases piston 78 to push fluid out of chamber 76 through passage 92 and check valve 100 into chamber 72. As that is occurring, piston 60 moves in tandem with piston 48 to displace fluid through passage 18 into annular space 16, thus compensating for the decrease in pressure resulting from downward thermal cycling within the well.

It can readily be seen that chambers 72 and 76 remain isolated from the wellbore fluids, while cavities 54 and 82 are in fluid communication with well fluids. Through the use of the seals as described, a compensation system is disclosed that compensates for an increase or a reduction in pressure in annular space 16 in response to external thermal effects. Movement of the components does not introduce the wellbore fluids into passage 18 or annular space 16.

There can be a difference in piston areas between piston 60 and piston 48, and the spring force of spring 52 is principally designed to counteract the inflation pressure anticipated in chamber 16 acting on the area of piston 48. By design, the bottom surface 50 will come into contact with top surface 68 of piston 60 as the sealing element 12 is expanded into contact with the casing or wellbore. If there is a reduction in pressure in the annular space 16, and piston 60 at that time is not against the travel stop 64, spring 80 will push piston 78 so as to displace fluid from chamber 76 to chamber 72 as pistons 60 and 48 move in tandem. Once piston 60 hits the travel stop 64, the spring 52 will continue to bias the piston 48, thus further displacing fluid from passage 18 into annular space 16 until all the compensation for a temperature reduction of well fluid has occurred within the apparatus. Those skilled in the art will appreciate that the components can be designed with different configurations to accommodate different expected temperature fluctuations in the wellbore.

The compensation apparatus is small and simple to construct and reliably operates to compensate for numerous cycles of increase and/or decrease in temperature while the packer P is held in position. The components' reliability is further enhanced by virtue of the configuration which excludes well fluids from the small passages where solids or other objects could cause plugging, which would undermine the operation of the compensation system.

The foregoing disclosure and description of the invention are illustrative and explanatory thereof, and various changes in the size, shape and materials, as well as in the details of the illustrated construction, may be made without departing from the spirit of the invention.

What is claimed:

1. A wellbore inflatable packer with a pressure compensation feature, comprising:

a body;

an inflatable element movable from a first position adjacent said body to an inflated position in contact with the wellbore;

said inflatable element defining an annular space between itself and said body;

a pressure-compensation system operative in said annular space to compensate for a change in pressure condition in said annular space;

said compensation system compensates for increases and decreases in annular space pressure while said element is engaged to the wellbore;

a first piston, one side of which communicates with said annular space, said piston varying the volume of said annular space responsive to pressure changes therein;

said first piston communicates with a first fluid reservoir which is isolated from wellbore fluids;

said first fluid reservoir permits fluid movement therein responsive to movement of said first piston;

said first piston comprises two components separated by a biasing device, whereupon when said element is inflated relative movement of said components occurs against said biasing device.

2. A wellbore inflatable packer with a pressure compensation feature, comprising:

a body;

an inflatable element movable from a first position adjacent said body to an inflated position in contact with the wellbore;

said inflatable element defining an annular space between itself and said body;

a pressure-compensation system operative in said annular space to compensate for a chance in pressure condition in said annular space;

said compensation system compensates for increases and decreases in annular space pressure while said element is engaged to the wellbore;

a first piston, one side of which communicates with said annular space, said piston varying the volume of said annular space responsive to pressure changes therein;

said first piston communicates with a first fluid reservoir which is isolated from wellbore fluids;

said first fluids reservoir permits fluid movement therein responsive to movement of said first piston;

a second fluid reservoir isolated from wellbore fluids and in fluid communication with said first fluid reservoir, whereupon fluid movement between reservoirs facilities movement of said first piston.

3. The packer of claim 2, further comprising:

a second piston in communication with said second fluid reservoir, said second piston biased towards displacement of fluid from said second to said first fluid reservoir.

4. The packer of claim 3, wherein:

movement of said first piston responsive to an increase of pressure in said annular space displaces fluid from said first toward said second fluid reservoir.

5. The packer of claim 4, further comprising:

a flow restriction in a first passage from said first to said second fluid reservoirs.

6. The packer of claim 5, wherein:

said flow restriction comprises a relief valve.

7. The packer of claim 6, further comprising:

a second passage between said first and second fluid reservoirs which allows fluid to pass from said second to said first fluid reservoir.

8. The packer of claim 2, wherein:

said first piston comprises two components, a first component having one side exposed to said annular space and said second component having one side exposed to said first fluid reservoir; and a biasing member disposed between said components.

9. The packer of claim 8, wherein:

said piston components defining a space therebetween for said biasing member, which further comprises a spring, with said space being open to wellbore pressure.

10. The packer of claim 9, wherein:

said spring biases said first component against pressure applied to said annular space when said inflatable element is moved to said inflated position while said first fluid reservoir supports said second component and said spring.

11. The packer of claim 10, wherein:

said first component moves to contact said second component upon pressure buildup to a predetermined level in said annular space which corresponds to said inflated position.

12. The packer of claim 11, further comprising:

a relief valve between said first and second fluid reservoirs;

whereupon further pressure build-up beyond said inflated position to a predetermined value, said relief valve opens and said piston components move in tandem to displace fluid between said fluid reservoirs.

13. The packer of claim 12, wherein:

a second piston in communication with said second fluid reservoir, said second piston being biased towards displacement of fluid from said second to said first fluid reservoir, whereupon an increase in pressure in said annular space overcomes said bias on second piston, by virtue of said tandem movement of said first and second components, as fluid is displaced from said first to said second fluid reservoir.

14. The packer of claim 13, wherein:

upon initial decrease of pressure in said annular space, said bias on said second piston displaces fluid from said second to said first fluid reservoir to move said second component.

15. The packer of claim 14, wherein:

upon further pressure decrease in said annular space, said components separate due to a travel stop on said second component and the force exerted by said spring.

16. An inflatable packer with compensation for increases or decreases in inflation pressure when the packer is set, comprising:

a compensation system in communication with an annular space between the packer body and an inflatable element, said compensation system relieves excess pressure buildup and compensates for pressure decrease in said annular space which occurs after the packer is inflated;

a first piston compensated for the fill pressure used to set the packer;

said first piston is in two segments with said fill pressure compensation disposed therebetween; and an enclosed fluid reservoir system isolated from wellbore fluids and operatively connected to said first piston to allow opposed movements of said first piston resulting in part from movement of fluid within said enclosed fluid reservoir system.

17. An inflatable packer with compensation for increases or decreases in inflation pressure when the packer is set, comprising:

a compensation system in communication with an annular space between the packer body and an inflatable element said compensation system relieves excess pressure buildup and compensates for pressure decrease in said annular space which occurs after the packer is inflated;

a first piston compensated for the fill pressure used to set the packer;

an enclosed fluid reservoir system, isolated from wellbore fluids and operatively connected to said first piston to allow opposed movements of said first piston resulting in part from movement of fluid within said enclosed fluid reservoir system;

said fluid reservoir system comprises a second biased piston whereupon movement of said first piston, at least in part, is made possible by movement of said second piston.

18. The packer of claim 17, wherein:

said second component has a travel stop to limit its motion towards said annular space, thus allowing said first and second components to separate due to said fill pressure compensation bias acting on said first component when said second component hits said travel stop.

19. An inflatable packer with compensation for increases or decreases in inflation pressure when the packer is set, comprising:

a compensation system in communication with an annular space between the packer body and an inflatable element said compensation system relieves excess pressure buildup and compensates for pressure decrease in said annular space which occurs after the packer is inflated;

a first piston compensated for the fill pressure used to set the packer;

an enclosed fluid reservoir system isolated from wellbore fluids and operatively connected to said first piston to allow opposed movements of said first piston resulting in part from movement of fluid within said enclosed fluid reservoir system;

said first piston is in two segments with said fill pressure compensation disposed therebetween;

said first segment acts on said annular space, whereupon pressure buildup in said annular space due to initial inflation, said first segment moves to overcome said fill pressure bias and into contact with said second segment.

20. The packer of claim 19, wherein:

upon further pressure increase after said initial inflation to a predetermined value, tandem movement of said segments fluid is displaced against said bias on said second piston; and whereupon a decrease in pressure in said annular space after said initial inflation, bias on said second piston displaces fluid against said second component, whereupon tandem movement of said components increases pressure in said annular space.

* * * * *